United States Patent [19]

Yokota et al.

[11] Patent Number: 4,982,098

[45] Date of Patent: Jan. 1, 1991

[54] SPEED COMPENSATED INTENSIFYING SCREEN FOR RADIOGRAPHY

[75] Inventors: Kazuo Yokota; Akihisa Saito, both of Yokohama; Takeshi Sawada, Kasugai, all of Japan

[73] Assignees: Kabushiki Kaisha Toshiba, Kanagawa; Fujita-Gakuen Health University, Aichi, both of Japan

[21] Appl. No.: 148,958

[22] Filed: Jan. 27, 1988

[30] Foreign Application Priority Data

| | | | |
|---|---|---|---|
| Jan. 29, 1987 | [JP] | Japan | 62-18986 |
| Mar. 13, 1987 | [JP] | Japan | 62-58071 |
| Mar. 20, 1987 | [JP] | Japan | 62-66699 |
| Mar. 20, 1987 | [JP] | Japan | 62-66700 |

[51] Int. Cl.[5] ..... G21K 4/00

[52] U.S. Cl. ..... 250/487.1; 250/483.1

[58] Field of Search ..... 378/185; 250/483.1, 250/487.1, 486.1

[56] References Cited

U.S. PATENT DOCUMENTS

| | | | |
|---|---|---|---|
| 4,701,622 | 10/1987 | Koizumi et al. | 250/487.1 |
| 4,772,803 | 9/1988 | Horiuchi et al. | 250/487.1 |

FOREIGN PATENT DOCUMENTS

| | | | |
|---|---|---|---|
| 0028521 | 5/1981 | European Pat. Off. . | |
| 0158787 | 10/1985 | European Pat. Off. . | |
| 73400 | 6/1981 | Japan | 250/483.1 |

*Primary Examiner*—Carolyn E. Fields

*Attorney, Agent, or Firm*—Finnegan, Henderson, Farabow, Garrett, and Dunner

[57] ABSTRACT

Disclosed is speed compensated intensifying screen which has a layer of phosphor and a protective layer superposed sequentially on a substrate and further has a light-absorbing layer capable of absorbing part of the light emitted from the layer of phosphor superposed thereon. By this light-absorbing layer, a plurality of regions differing in speed are formed within the layer of phosphor. In the plurality of regions, the speed is continuously changed across the borderlines between the regions. This continuous change in density across the borderlines prevents the borderlines between the regions of speed from appearing as line patterns in the produced X-ray radiograph. The intensifying screen of the grade adapted for X-ray radiography of the chest effects proper speed correction by incorporating therein a plurality of regions of speed formed so as to conform to the various internal organs in the chest such as the upper and lower mediastinums, the hilums of the lung, and the lungfields. The intensifying screen of the grade adapted for X-ray radiography of the head effects proper speed correction by incorporating therein a plurality of regions of speed formed so as to conform to the various parts of the head from the central part through the portion near the scalp. The intensifying screen of the grade adapted for X-ray radiography of the upper and lower jaws and the peripheries thereof effects proper speed correction such as to prevent the shadow of the backbone from giving rise to portion deficient in radiographic density.

12 Claims, 7 Drawing Sheets

SPEED COMPENSATED INTENSIFYING SCREEN FOR RADIOGRAPHY

The present application claims priority of Japanese Patent Application Nos. 62-018986 filed on Jan. 29, 1987, 62-058071 filed on Mar. 13, 1987, and 62-066699 and 62-066700 respectively filed on Mar. 20 1987.

FIELD OF THE INVENTION AND RELATED ART STATEMENT

The present invention relates to speed compensated intensifying screens to be used for diagnostic examination of various parts of the human body and for use in the X-ray radiography. More particularly, this invention relates to speed compensated intensifying screen for producing clear images of various given human organ on one X-ray radiograph film as in the radiography of the chest, of the jaws in general and the periphery thereof in dentistry and surgery specilizing in the therapy of the oral cavity.

In the application of the radiography to medical diagnosis, the practice of using a sensitive film in combination with an intensifying screen is generally resorted to.

The intensifying screen is generally configurated by superposing on a substrate such as of paper or plastic material, a layer of a phosphor capable of emitting light under X-ray excitation and a thin protective film for protecting the layer of phosphor in the order mentioned. In the X-ray radiography, two such intensifying screens and one X-ray film interposed between the intensifying screens are used as held fast in a cassette.

In the conventional intensifying screen, the speed of the layer of phosphor is substantially uniform throughout the entire area of a given plane. When the intensifying screen of this nature is used in the X-ray radiography of a part of the human body such as the chest which contains a plurality of organs exhibiting widely varied absorption coefficients to the X-rays, it is difficult to produce a clear image of all such component organs.

In recent years, the development of so-called intensifying screens which have formed within one intensifying screen a plurality of regions possessing different degrees of speed has been gathering momentum. So far, the following inventions have been proposed, for example.

(1) An intensifying screen set which combines an intensifying screen of full size and an intensifying screen formed in the shape conforming to a particular part requiring higher speed (Japanese Patent Application Disclosure SHO No. 59(1984)-83,099).

(2) An intensifying screen set which combines an intensifying screen of ordinary run and a sheet adapted to effect partial absorption or reflection of the light emitted from the intensifying screen (Japanese Patent Application Disclosure SHO No. 61(1986)-155,900).

(3) An intensifying screen which has formed within a layer of phosphor a pattern capable of partially absorbing the light emitted from the layer of phosphor (Japanese Patent Application Disclosure SHO No. 62(1987)-24,200).

(4) An intensifying screen which has interposed between a layer of phosphor and a protective film a pattern layer capable of partially absorbing or reflecting the light emanating from the layer of phosphor (Japanese Patent Application Disclosure SHO No. 62(1987)-231,200).

The invention of (1), however, entails a disadvantage that discontinuity of speed occurs along the borderline between the part of higher speed and the remaining part and the borderline is suffered to appear as a line pattern in the produced X-ray radiograph.

The method which resorts to the partial absorption or reflection of the light emanating from the layer of phosphor as in the inventions of (2) through (4) is effected by directly printing in a pertinent pattern on the film or layer of phosphor a pigment or other similar coloring substance capable of absorbing the light emanating from the phosphor. In the method of this principle, the following measure is taken to prevent the borderline between a colored part and a non-colored part from appearing in the produced X-ray radiograph.

An original photoengraving plate is produced by preparing a plurality of films colored as varied in density according to a given intensifying pattern, superposing these films in such a manner that the composite density will continually decrease in the direction from the light passing part to the light absorbing part, and photographing the composite surface of the superposed films. Then, a printing plate is produced from the original photoengraving plate and a light absorbing layer is formed thereon as by gravure printing to give rise to a gradient change of density from the light absorbing part to the light passing part.

Indeed this method enables borderlines of change of density arising in the stage of printing to be reduced to a gradient change so delicate as to elude notice by unaided eyes. It nevertheless has a disadvantage that the borderlines are suffered to appear as line patterns in the produced X-ray radiograph.

As an intensifying screen of special grade which, unlike the aforementioned intensifying screen of ordinary grade, has formed therein a speed distribution conforming specifically to the part of the human body selected as an object for radiography, an X-ray intensifying screen having formed in the central part thereof strips of high-speed part corresponding to the mediastinum (Japanese Patent Application Disclosure SHO 56(1981)-73,400), for example, has been introduced to the art.

The exclusive intensification of the central part as taught by this invention, however, falls short of producing on one X-ray radiograph a clear image of the hilum of the lung, i.e. the trachease, the bronchi, and the periphery thereof, and the mediastinum, inclusive of the lungfield because the upper and lower regions of one and the same mediastinum have different X-ray absorption coeffient and also because the mediastinum and the lungfield have different absorption coefficient. To cope with this particular problem, there has been proposed an intensifying screen for use in the X-ray radiography of the chest, which has speed elaborately varied to suit the various organs concerned, namely the lungfield region, the upper region of the mediastinum, the lower region of the mediastinum, and the right and left regions of the hilum of the lung, for example (Japanese Patent Application Disclosure SHO No. 62(1987)-231,199). Owing to the presence of the heart beneath the lower region of the mediastinum, for example, the X-ray radiograph of the chest produced by using this intensifying screen still contains a vague portion in the otherwise clear image. In the circumstances, the desirability of further improvement in the intensifying screen has been finding enthusiastic recognition. Further, since this intensifying screen for use in the X-ray radiography of the chest has speed varied for each of the regions concerned, it has a disadvantage that the borderlines of difference in density are suffered to appear as line patterns in the produced image similarly to the disadvantage mentioned above.

The existing intensifying screens of the kind having speed corrected to suit the particular part of the human body as an object for radiography are mainly intended for use in the X-ray radiography of the chest. Notwithstanding the X-ray radiography naturally constitutes itself a highly efficient means for the diagnostic examination of the head and for the diagnosis in the domains of dentistry and surgery specializing in the oral cavity, no intensifying screen has yet been developed which has speed corrected to suit these parts of the human body as an object for radiography.

In the diagnostic examination of the head, for example, such special X-ray radiography as "Mr. Towne's method" has found popular utility. The Mr. Towne's method consists in taking radiograph of the head of a given patient in the front-to-back direction, suits the purpose of radiography of the occipital bone in its entirely, and serves as an important means for the diagnosis of diseases in the head as because of the ability thereof to project the backbone on the interior of the occipital foramen. This particular direction of radiography is also advantageous for cerebral angiography.

The X-ray radiography of the head has had no alternative to date but to use an intensifying screen which has uniformly distributed has yet been developed which is intended exclusively for the X-ray radiography of the head. In the cross section of the head in the direction of radiography, therefore, the distance of transmission of X-rays in the head differs widely in the central part and in the part near the scalp. It is only the backbone, the central part of the occipital bone, etc. aimed at by the X-ray radiography that are radiographed clearly enough to serve for the purpose of actual diagnosis. The part near the scalp permits excessive transmission of X-rays and fails to form an image fit for diagnosis in the X-ray radiograph Thus, the Mr. Towne's method suffers from a disadvantage that the range of the head allowed to form in the X-ray radiograph a clear image fit by any measure for the diagnosis is rather limited Further in the X-ray radiography of the upper and lower jaws and the periphery thereof which is utilized for diagnosis in the domains of dentistry and surgery specializing in the oral cavity, intensifying screens having uniformly distributed speed in the layer of phosphor are used for the same reason as described above. Owing to the presence of the cervical vertebra exhibiting a notably different absorption coefficient to X-rays, no accurate diagnosis is obtained because not proper radiographic density is obtained only in the part corresponding to the cervical vertebra As a solution to this problem, the practice of making necessary correction on the X-ray apparatus side by adjusting the intensity of X-rays in terms of voltage or amperage thereby substantially equalizing the density of the part corresponding to cervical vertebra with that of the remaining part is also used. This method has a disadvantage that the apparatus itself is expensive and is devoid of versatility.

OBJECT AND SUMMARY OF THE INVENTION

An object of this invention, therefore, is to provide speed compensated intensifying screens which effect highly desirable correction of speed proper to the part of the human body subjected to radiography without suffering borderlines of change of density, therefore, ensures satisfactory radiography for the purpose of diagnosis.

Another object of this invention is to provide an speed compensated intensifying screen for use in the X-ray radiography of the chest, which gives proper correction of speed on an X-ray radiograph so as to produce on the film a clear image of the part of the human body necessary for diagnostic examination of the chest such as, for example, the lungfield, the hilum of the lung, and the mediastinum and, at the same time, prevents the borderlines of change in density in the light-absorbing layer from standing out in the produced image.

A further object of this invention is to provide a speed compensated intensifying screen for use in the X-ray radiography of the head, which gives proper correction of speed on an X-ray radiographic film so as to produce on the film a clear image of not only the backbone and the occipital bone, i.e. essential parts for the X-ray radiography of the head, but also such peripheral parts as the part near the scalp and, at the same time, prevents the borderlines of change of density in the light-absorbing layer intended for correction of speed from standing out in the produced image.

Yet another object of this invention is to provide a speed compensated intensifying screen for use in the X-ray radiography of the upper and lower jaws and the periphery thereof, which gives a proper correction of speed on an X-ray radiograph being used in the X-ray radiography of the upper and lower jaws and the periphery thereof so as to produce on the film a clear image of the entire aspect of the pertinent parts inexpensively and safely while precluding the occurrence of a difference in density due to the shadow produced by the cervical vertebra and, at the same time, prevents the borderlines of change in density in the light-absorbing layer intended for correction of speed from standing out in the image.

This invention is directed to a speed compensated intensifying screen for radiography, comprising a substrate, a layer of phosphor formed on the substrate, a protective layer formed on the layer of phosphor, and a light-absorbing layer serving to absorb the light emitted from the aforementioned layer of phosphor proportionately to the part of the human body subjected to radiography, in which intensifying screen is characterized by the fact that the aforementioned layer of phosphor is enabled by the aforementioned light-absorbing layer to create therein a plurality of regions differing in speed and the speed across each of the boundaries of the aforementioned plurality of regions of speed is continuously varied.

The plurality of regions of speed in the present invention are fixed in accordance with the particular part of the human body subjected to radiography. The ratio of change of speed across each of the borderlines between the plurality of regions of speed, i.e. the speed gradient per unit length in a minute increment, is so continuous that no visible line will appear in the produced X-ray radiograph. This rule is similarly applicable to the change of speed which takes place within each of the regions of speed.

When the continuity of the change in speed is measured with a densitometer, even in the conventional intensifying screen on which the change in speed is imparted by superposition of films containing a given image in gradually varied levels of density, breaks in the continuity of the change in density cannot be expressed in definite numerical values because of noises inevitably generated during the measurement. When this intensifying screen is used in X-ray radiography, the produced X-ray radiograph clearly shows line patterns evincing the presence of breaks of continuity of the change in speed. It is thus difficult to express the continuity of the change in speed. It is, however, possible to quantify the continuity of the change in speed based on the presence or absence of line patterns to be visibly found in the X-ray radiograph.

As one concrete embodiment of the present invention, an intensifying screen for use in the X-ray radiography of the chest.

In this intensifying screen for the X-ray radiography of the chest, the plurality of regions differing in speed created by the light-absorbing layer in the layer of phosphor substantially comprise, as illustrated in FIG. 1, for example, a region A substantially corresponding to the lower part of the mediastinum and located substantially in the central part, a trapezoidal region B of high speed continuously diverging from the bottom part of the region A toward the abdomen side, a region C corresponding to the right hilum of the lung and a region D corresponding to the left hilum of the lung with the speed substantially continuously lowered from the opposite lateral sides of the region A toward the right and left lungfields, a region E located in the upper part of the region A and corresponding to the upper part of the mediastinum with the speed substantially continuously lowered upwardly and to the opposite sides, a region F and a region G with the speed substantially continuously lowered from the opposite sides of the region B toward the right and left lungfields, a region H corresponding to the right lungfield, and a region I corresponding to the left lungfield and, further, the speed across each of the borderlines of the aforementioned plurality of regions of speed is continuously varied.

The regions A through I of speed in the intensifying screen for the X-ray radiography of the chest possess such a positional relationship as illustrated in FIG. 1. This positional relationship need not be strictly defined but may be accepted so long as it approximates what is illustrated in FIG. 1.

Properly, the magnitudes of speed in these regions are such that where the magnitude of speed in the regions A and B taken as 100, the magnitude of speed in the regions H and I corresponding to the lungfield is not more than 50, and the magnitudes of speed in the regions H and I. In the regions C, D, F, and G, the speed is substantially continuously lowered from the boundaries of the regions A and B toward the right and left lungfields and, in the region E, the speedis continuously lowered from the boundary of the region A upwardly and toward the right and left lungfields as indicated by the arrows of solid line in FIG. 1.

In a preferred speed distribution, regions A' and B' indicated by a dotted line in FIG. 1 are formed as more restricted regions of high speed and the regions A and B excluding the regions A' and B' have the change of speed thereof smoothened as a whole so as to permit a slight decrease of the speed toward the lungfield and upwardly.

By creating the regions of speed corresponding to the pertinent internal organs and thereby effecting corrections of speed properfor the organs, the regions of such organs as the lungfield, the hilums of the lung, and the mediastinum areenabled to be radiographed in clear contrast on one X-ray radiograph. Moreover, the boundaries of the regions of speed are not suffered to stand out in the produced image and the diagnostic examination can be carried out accurately.

As another typical embodiment of the present invention, an intensifying screen forthe X-ray radiography of the head can be cited.

In this intensifying screen for the X-ray radiography of the head, the light-absorbing layer enables the layer of phosphor to create therein a plurality ofregions differing in speed and the plurality of regions substantially comprise, as illustrated in FIG. 2, a substantially elliptical region J of high speed located substantially in the central part relative to the longitudinal cross section of the head, a region L of low speed corresponding to the outside of the contour of the head, and a region K corresponding to the head except for the region J of high speed and possessing a magnitude of speed intermediate between the magnitude of speed of the region J of high speed and the magnitude of speed of the region L and the speed across each of the borderlines of the regions of speed is continuously varied.

The positional relationship of the regions of speed in the intensifying screen for the X-ray radiography of the head need not be strictly defined but may be accepted so long as it approximates what is illustrated in FIG. 2. For example, it is desired to be fixed as follows. In the case of an ordinary intensifying screen measuring 300 mm×250 mm and used for the X-ray radiography of the head, a region J of high speed substantially shaped like an ellipsis possessing a major axis in the range of 80 to 120 mm and a minor axis in the range of 40 to 80 mm is formed substantially in the central part, a region K corresponding to the head is formed around the region J, and a region L of low speed is formed outside the contour of the head.

Properly, the magnitudes of speed of the plurality of regions of speed are desired to be such that when the magnitude of speed in the region J of high speed is taken as 100, the magnitude of speed in the region L of low speed outside the contour of the head is not more than 50, and the magnitude of speed in the region K is intermediate between the magnitude of speed in the region J and the magnitude of speed in the region of L. In a desirable speed distribution, the speed in the region K is substantially continuously lowered radially from the region J of high speed to the region L of low speed as indicated by the arrow in the diagram.

By creating such regions of speed as described above, the differences in the absorption coefficient of X-rays due to the differences in the distance of X-ray transmission in the cross section of the head in the direction of the X-ray radiography and the differences in the absorption coefficient of X-ray among the different organs concerned are corrected so that the central part of the head to the part near the scalp are all radiographed in clear contrast in one X-ray radiograph. The borderlines between the plurality of regions of speed are not suffered to stand out in the produced image and the diagnostic examination can be carried out accurately.

As still another typical embodiment of the present invention, an intensifying screen for X-ray radiography of the upper and lower jaws and the periphery thereof is cited.

In this intensifying screen for the X-ray radiography of the upper and lower jaws and the periphery thereof, the light-absorbing layer enables the layer of phosphor to create therein a plurality of regions differing in speed and the plurality of regions differing in speed substantially comprise, as illustrated in FIG. 3, for example, a belt-like region M of high speed extending from the central part of one end to the central part of the other end and substantially corresponding to the position of the cervical vertebra and another region N as illustrated in FIG. 3 and the speed across each of the borderlines between the plurality of regions of speed is continuously varied.

The belt-like region M of high speed in the intensifying screen for the X-ray photography of the upper and lower jaws and the periphery thereof is desired, in an ordinary intensifying screen measuring 150 mm×300 mm, 150 mm×303 mm, 200 mm×300 mm, or 200 m×300 mm and intended for use in the X-ray radiography of the upper and lower jaws and the periphery thereof, to be located along the center line extending from the center of one major side to the center of the other major side in a width in the range of 5 to 40 mm on either side of the center line.

The magnitudes of speed in the regions of speed are desired to be such that when the magnitude of speed in the belt-like region M is taken as 100, the magnitude of speed in the other region N is in the range of 40 to 80. Further, these regions are desired to be given a similar change of speed as indicated within the range of speed correction ratio of any of the three types, Type 1 through Type 3, shown in the graph of speed distribution of FIG. 3. If the speed of the other region N is less than 40 where that of the belt-like region M of high speed is 100, the produced X-ray radiograph shows unduly high contrast and suffers from lack of uniformity of density. If the speed of the region N exceeds 80, the effect of this invention is not manifested fully because no sufficient correction of speed is effected.

In the actual use for the X-ray radiography, this intensifying screen for the X-ray radiography of the upper and lower jaws and the periphery thereof is used as nipped between to intensifying screens. If the intensifying screen possessing such a high speed correction ratio as Type 3 of FIG. 4 is used in combination with intensifying screens having no speed correction and receiving the light from the phosphor uniformly, the effect of the invention is similarly obtained because the amount of light impinging on the X-ray film gives rise to a speed distribution of Type 2, for example.

By forming a region of high speed in the position corresponding to the cervical vertebra as described above, the upper and lower jaws and the periphery thereof are enabled to be radiographed in uniform density.

The light-absorbing layer in the intensifying screen of the present invention may be formed by any of the following procedures.

(1) A layer for absorbing the light emitted from the phosphor is formed on the surface of a layer of phosphor, in a shape conforming with the shape of the part of the human body subjected to radiography.

(2) A layer for absorbing the light emitted from the phosphor is formed inside a layer of phosphor, in a shape conforming with the shape of the part of the human body subjected to radiography.

(3) A layer for absorbing the light emitted from the phosphor is formed on the surface of a protective layer, in a shape conforming with the shape of the part of the human body subjected to radiography.

In all the methods described above, the method of (2) proves to be particularly effective because the produced light-absorbing layer provides a high ratio of speed correction, possesses highly desirable adhesiveness to the X-ray film, exhibits satisfactory granularity of texture, and enjoys high sharpness of image.

Where the light-absorbing layer is formed by the procedure of (2), the intensifying screen of the present invention is manufactured as follows.

First, as illustrated in FIG. 5, a first layer **14*a* of phosphor is formed on a substrate 12 made of plastic film such as polyester or non-woven fabric by applying on the substrate 12** a paste prepared by adding a phosphor such as $CaW0_4$, $Gd_20_2S$:Tb, or BaFCl:Eu to an organic binder and subsequently drying the applied layer of the paste.

Then, on a plastic film such as of polyester, a light-absorbing layer 16 is formed by applying on the plastic film a pigment capable of absorbing the light emitted from the phosphor used in the layer **14*a* of phosphor in such a manner that the applied layer of the pigment will give rise to a plurality of regions of speed, depending on the particular part of the human body subjected to radiography. During the formation of this light-absorbing layer 16**, the application of the pigment is so regulated that the density is continuously changed across each of the borderlines between the regions of speed.

For the formation of the light-absorbing layer 16 mentioned above, the following two procedures are available.

(1) The relevant part of the body of a person of standard body type is radiographed at the focal point and at points separated by gradually increased intervals from the focal point until fine details of the part and the osteal components blur out along their peripheries, to prepare a set of photogravure plates of varying shade. A printing plate is produced from the photogravure plates. A light-absorbing layer is formed by applying a coating material with the aid of the plate using the printing technique such as the gravure printing.

(2) As illustrated in FIG. 6, a light-shielding plate 20 provided with an opening 22 conforming with a desired region of high speed is set in place and a planar light source 24 is disposed directly on or at a prescribed distance upward from the light-shielding plate 20. A sensitive film 26 is disposed at a prescribed distance downward from the light-shielding plate 20. Then, a collimated beam of light (indicated by the arrow z in the diagram) is projected downwardly from above the planar light source 24 to effect exposure of the sensitive film 26. In this case, the light emanating from the planar light source 24 is converted into scattered light (indicated by the arrow y in the diagram), depending on the positional relation between the light-shielding plate 20 and the planar light source 24 and that between the light-shielding plate 20 and the sensitive film 26. Since the sensitive film 26 is exposed to the scattered light, continuous change in density is produced along the borderline between the opening corrsponding to the region of high speed and the remaining part. A light-absorbing layer is formed in the same manner as in (1) above, using as a photogravure plate the sensitive film which has been exposed as described above.

Thereafter, the light-absorbing layer 16 is mounted, on the layer 16 and a second layer **14*b* of phosphor is likewise mounted on the first layer 14a- of phosphor and a protective film 18 is superposed on the second layer 14*b*** of phosphor to complete an intensifying screen aimed at.

Owing to the presence of the light-absorbing layer incorporated in the layer of phosphor in the manner described above, the speed correction ratio could be easily varied, when necessary, by simply adjusting the position at which the light-absorbing layer is formed, namely by varying the thickness of the first layer of phosphor and that of the second layer of phosphor.

Optionally, the light-absorbing layer 16 may be directly superposed on the first layer 14*a* of phosphor instead of on the plastic film.

When an intensifying screen is manufactured by using a light-absorbing layer formed by either of the procedure described above, the change in speed across each of the borderlines between the plurality of regions of speed is rendered continuous. As a result, these borderlines are not suffered to stand out as line patterns in the image. Thus, the intensifying screen ensures production of X-ray radiographs of quality.

DETAILED DESCRIPTION OF PREFERRED EMBODIMENTS

Now, the present invention will be described more specifically below with reference to working examples.

EXAMPLE 1

Figure 1:
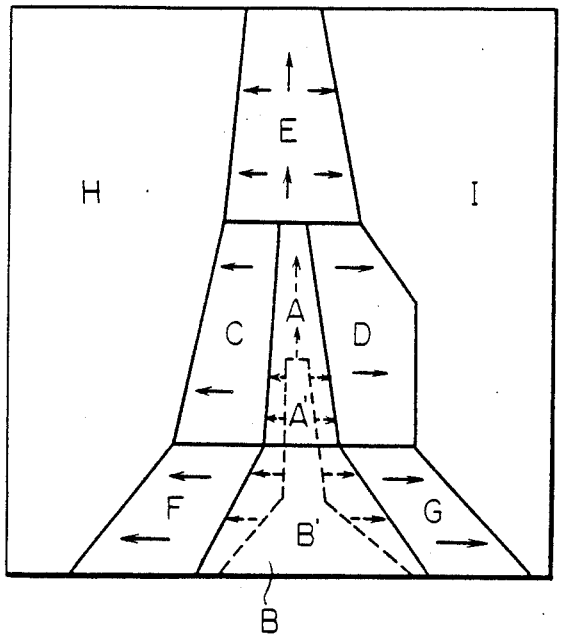
FIG. 1 is a diagram schematically illustrating a pattern of a plurality of regions of speed in an intensifying screen of the present invention for use in the X-ray radiography of the chest.

An intensifying screen (354 mm×354 mm in area) for X-ray radiography of the chest was produced by the following procedure, using calcium tungstate as phosphor and fixing the magnitudes of speed in the pattern of FIG. 1 so that when the magnitude of speed in the regions A′ and B′ was taken as 100, that of speed in the regions H and I would fall at 40.

Preparation of light-absorbing layer

Figure 7:
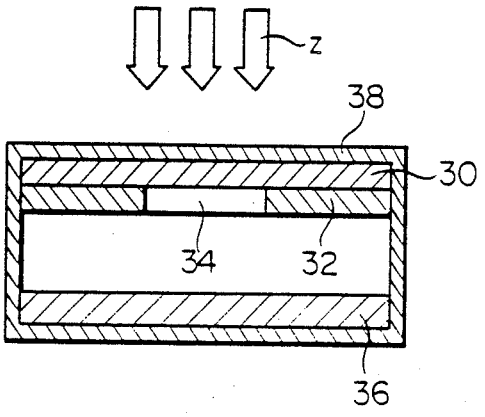
FIG. 7 is a cross section illustrating the manner of manufacture of a photogravure plate to be used in the formation of a light-absorbing layer in a typical intensifying screen as one embodiment of the present invention.

FIG. 7 is a cross section illustrating the manner of absorbing manufacture of a photogravure plate used for the formation of a light-absorbing layer. With reference to this diagram, 30 stands for an intensifying screen used as a planar light source. A black paper pattern 32 provided with an opening 34 of the shape conforming to a desired pattern of speed correction and intended to intercept the light emanating from the planar light source was placed in close contact with one surface of the intensifying screen 30. This black paper pattern 32 and an X-ray film 36 disposed at a distance of about 10 mm downward from the lower side of the paper pattern 32 were enclosed in a cassette 38 and exposed to a beam of X-rays as indicated by the arrow z in the diagram. Then, the X-ray film was exposed to the scattered light from the planar light source. Consequently, there was obtained a photogravure plate having density smoothly and continuously varied across each of the borderline between the part corresponding to the black paper pattern 32 and the remaining part.

Figure 8:
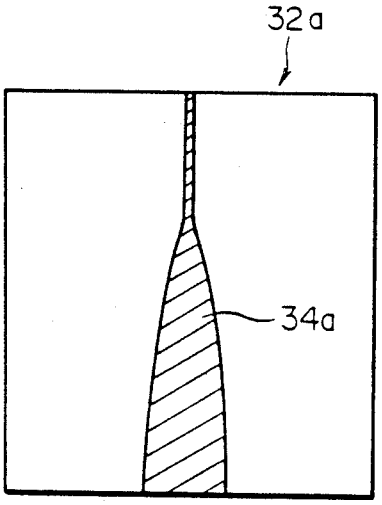
FIG. 8 and FIG. 9 are diagrams each schematically illustrating a light-shielding member used in the manufacture of a photogravure plate.
Figure 9:
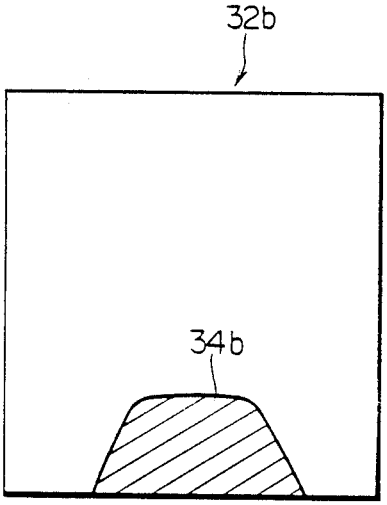

In the present working example, two black paper patterns were prepared which contained openings shaped as illustated respectively in FIG. 8 and FIG. 9 as desired patterns of speed correction. An X-ray film was exposed to light first through the black paper pattern 32*a* possessing the opening 34*a* shown in FIG. 8 (as hatched) and subsequently through the black paper pattern 32*b* possessing the openings 34*b* shown in FIG. 9 (as hatched), to produce a photogravure plate.

Then, a printing plate was produced from the photogravure plate. A yellow pigment capable of absorbing the light emitted from calcium tungstate was applied on a film of polyester 10 μm in thickness by gravure printing, with the aid of the photogravure plate. Thus, a photo-absorbing layer was formed.

Preparation of intensifying screen

Figure 5:
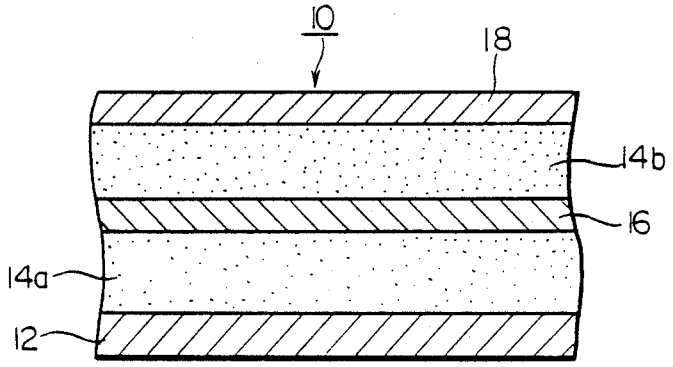
FIG. 5 is a cross section illustrating a typical structure of an intensifying screen of the present invention.
Figure 6:
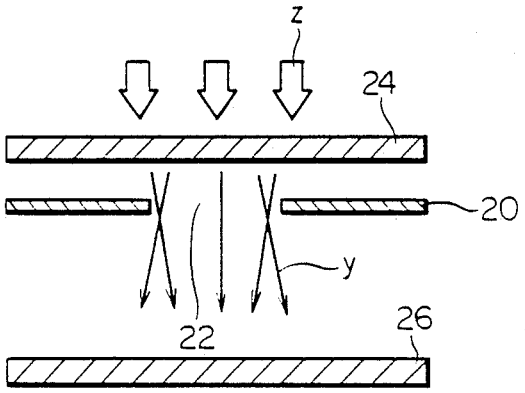
FIG. 6 is a diagram illustrating a typical principle for the manufacture of a photogravure plate to be used in the formation of a light-absorbing layer in an intensifying screen of the present invention.

A slurry was prepared by mixing 20% by weight of calcium tungstate as phosphor with 2% by weight of polyvinyl butyral and 78% by weight of butyl acetate as a binder. As shown in FIG. 5 second layer 14*b* of phosphor about 75 μm in thickness was formed by applying this phosphor slurry on a protective layer 18 made of polyester film about 10 μm in thickness and drying the applied layer of the slurry.

Subsequently, the light-absorbing layer 16 formed by the aforementioned procedure was superposed on the second layer 14*b* of phosphor. On this layer 16 a first layer 14*a* of phosphor 75 μm in thickness was formed by applying a phosphor slurry of the same composition as mentioned above on the second layer 14*b* of phosphor and drying the applied layer of the slurry.

Thereafter, a substrate 12 made of polyester film 250 μm in thickness was attached fast to the upper surface of the aforementioned first layer 14*a* of phosphor, to produce an intensifying screen 10 for X-ray radiography of the chest.

Figure 10:
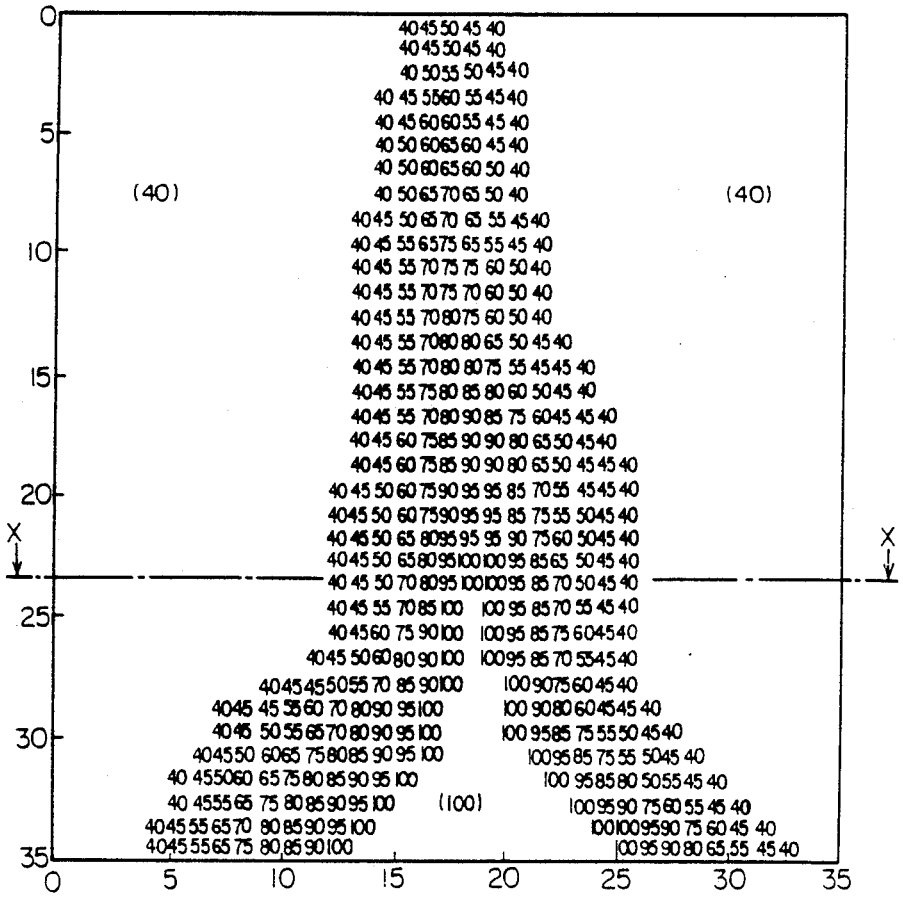
FIG. 10 is a diagram illustrating the speed distribution in an intensifying screen as one embodiment of the present invention to be used for the X-ray radiography of the chest.
Figure 11:
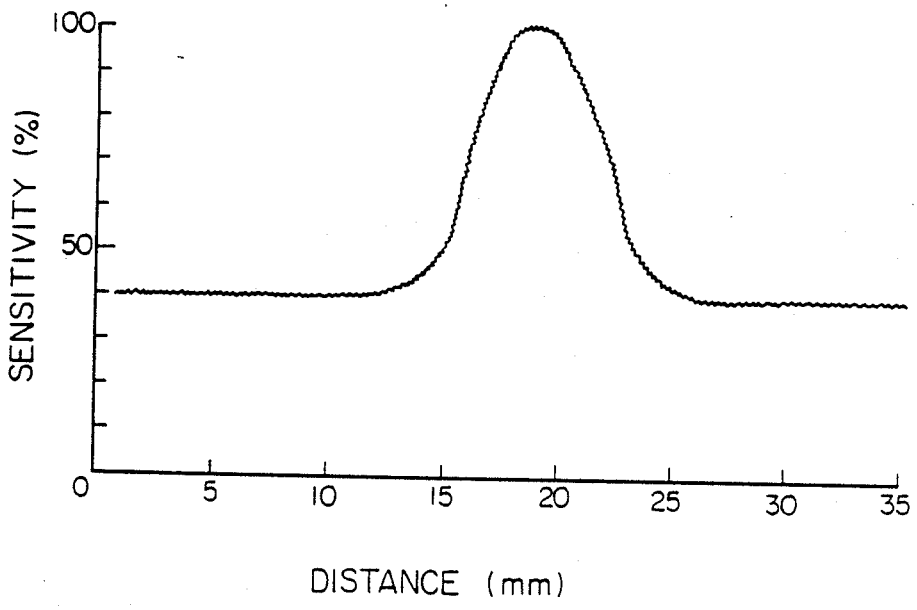
FIG. 11 is a graph showing the results of the determination of change in speed along the line X—X in FIG. 10.

The intensifying screen thus obtained was superposed on an X-ray film and enclosed in a cassette. This X-ray film was exposed to a beam of X-ray film was tested for density distribution with a densitometer. When the X-ray film was examined with respect to speed distribution in the intensifying screen, this intensifying screen was found to possess a speed distribution as shown in FIG. 10. When the X-ray film was tested for change in speed along the line X—X in the diagram of FIG. 10, the intensifying screen was found to possess such a density distribution as shown in FIG. 11. As clearly noted from this diagram, the speed was smoothly and continuously changed across the borderlines between the regions of speed and within the regions speed. This fact clearly indicates that no visible line patterns were found in the produced X-ray radiograph.

Then, the X-ray radiography of the chest was conducted on 50 subjects, using the intensifying screen possessing the speed distribution mentioned above. Consequently, in virtually all the cases, the lungfield, the trachea and the bronchus, and even the part of the bronchus overlapping the hilum of the left lung, were clearly radiographed in highly satisfactory contrast.

The intensifying screen of the present case for the Xray radiography of the chest possessed a substantially continuous change in speed as shown in FIG. 10 because it was formed by using as the photogravure plate an X-ray radiograph having the light-absorbing layer blurred with the scattered beam of light from the planar light source. As a result, the pertinent internal organs could be radiographed clearly without entailing the occurrence of drawbacks detrimental to the diagnostic examination of the part such as line patterns in the image originating in the borderlines of change in density in the light-absorbing layer. Thus, it is evident that when the intensifying screen for the X-ray radiography of the chest possesses the speed distribution illustrated in FIG. 10 is highly effective in the diagnostic examination of the chest.

EXAMPLE 2

A light-absorbing layer was prepared by the following procedure in the place of the light-absorbing layer of Example 1.

Preparation of light-absorbing layer

First, an X-ray radiograph of the chest of a person of standard body type was prepared and it was radiographed with the focal point moved to a certain distance. Then, the photograph of the chest taken at the aforementioned distance from the focal point was again radiographed with the focal point again moved to a certain distance. When a radiograph produced after repeating this procedure was found to show the minute details and the peripheries of bone in a perfectly blurred state, it was used as a photogravure plate. Then a printing plate was produced from the photogravure plate and a light-absorbing layer was formed using the printing plate by following the procedure of Example 1.

Preparation of intensifying screen

Subsequently, an intensifying screen for use in the X-ray radiography of the chest was produced using the lightabsorbing layer by following the procedure of Example 1.

When the chest was actually X-ray radiographed by using the intensifying screen obtained as described above, the internal organs in the chest were clearly radiographed, indicating that the intensifying screen was as effective in producing an X-ray radiograph as the intensifying screen of Example 1.

EXAMPLE 3

Figure 2:
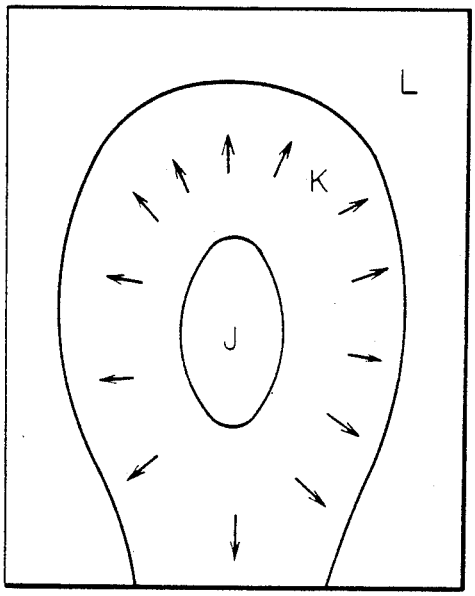
FIG. 2 is a diagram schematically illustrating a pattern of a plurality of regions of speed in an intensifying screen of the present invention for use in the X-ray radiography of the head.

An intensifying screen for X-ray radiography of the head (300 mm×250 mm) was prepared by the following procedure, using calcium tungstate as a phosphor and fixing the speed distribution such that the speed in the region L would fall at 40 where the speed in the region J was taken as 100 in the diagram of FIG. 2.

Preparation of light-absorbing layer

A black light-shielding plate provided in the central part thereof with a substantially elliptical opening measuring 150 mm in major diameter and 100 mm in minor diameter. An X-ray film was disposed at a distance of about 10 mm downward from the light-shielding plate and was exposed to light in the same manner as in Example 1. A printing plate was produced by using this X-ray film as a photogravure plate. Then, on a polyester film 10 μm in thickness, a light-absorbing layer was formed with yellow pigment by following the procedure of Example 1.

Preparation of intensifying screen

Similarly to the intensifying screen of the construction illustrated in FIG. 5, the same calcium tungstate-containing slurry as used in Example 1 was applied on a protective film 18 of polyester about 10 μm in thickness and the applied layer of the slurry was dried, to give rise to a second layer **14*b* of phosphor about 50 μm in thickness. Then, the light-absorbing layer 16 formed by the method described above was superposed on the second layer 14*b* of phosphor. Further the phosphor slurry of the aformentioned percentage composition was applied on the light-absorbing layer 16 and the applied layer of the slurry was dried, to give rise to a first layer 14*a* of phosphor 50 um in thickness. Thereafter, a substrate 12 of polyester film 250 μm in thickness was attached fast to the upper side of the layer 14*a* of phosphor, to complete an intensifying screen 10**.

The intensifying screen thus obtained was placed on top of an X-ray film, enclosed in a cassette, exposed to a beam of X-rays, and tested for speed distribution in the same manner as in Example 1. The produced X-ray radiograph was found to possess a speed distribution illustrated in FIG. 12.

As concerns the continuity of the change in speed, the X-ray radiograph showed no discernible line pattern, indicating that the speed was changed with sufficient continuity.

Then, 50 persons were subjected to clinical test by the "Mr. Towne's method" of the head using the intensifying screen possessing this speed distribution. In virtually all the X-ray radiographs produced in the test, not merely the backbone and the occipital bone but also the portion near the scalp were clearly radiographed with highly satisfactory contrast.

Figure 12:
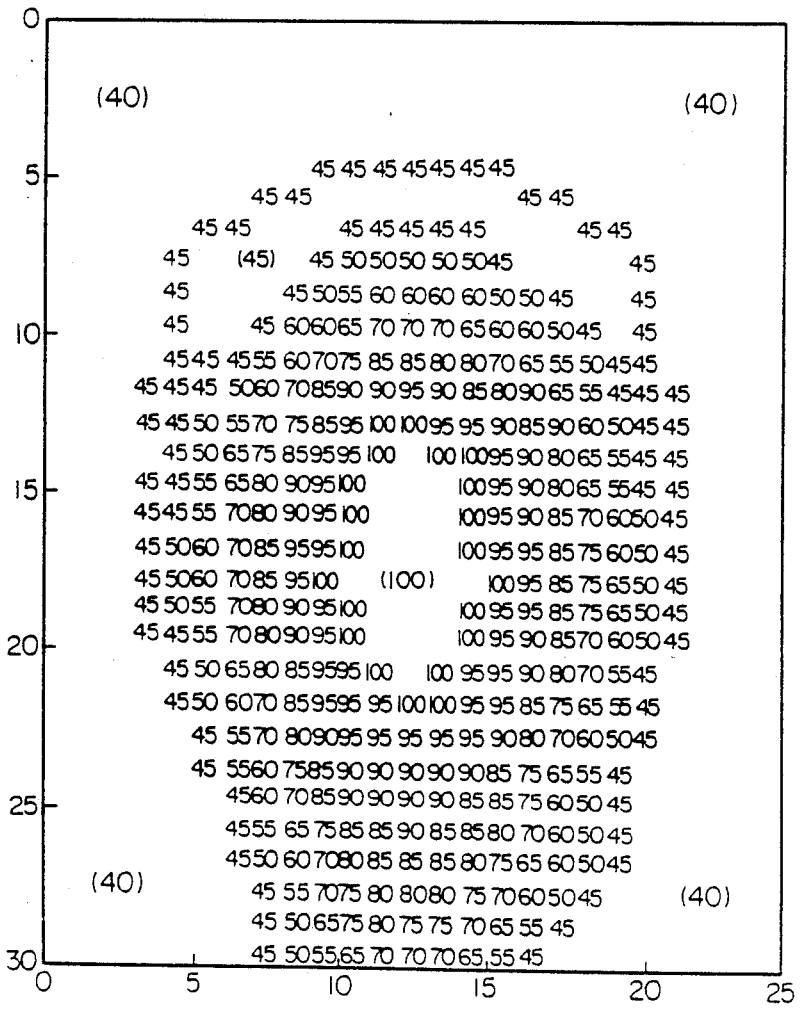
FIG. 12 is a diagram illustrating the speed distribution in an intensifying screen as another embodiment of this invention to be used for the X-ray radiography of the head.

The intensifying screen obtained in this working example for use in X-ray radiography of the head possessed a substantially continuous change in speed as illustrated in FIG. 12 and, therefore, enabled the head to be clearly radiographed even to the peripheral part such as the portion near the scalp. It did not give rise to any such detriment to the diagnostic examination as line patterns which would possibly be produced because of the borderlines in change of density in the light-absorbing layer. The intensifying screen for the X-ray radiography of the head possessing the speed distribution illustrated in FIG. 12, as obvious from the clinical results mentioned above, permits acquisition of such information concerning the portion near the scalp as has never been utilized for diagnostic examination. Thus, it is highly effective in the diagnostic examination of the head.

EXAMPLE 4

Figure 3:
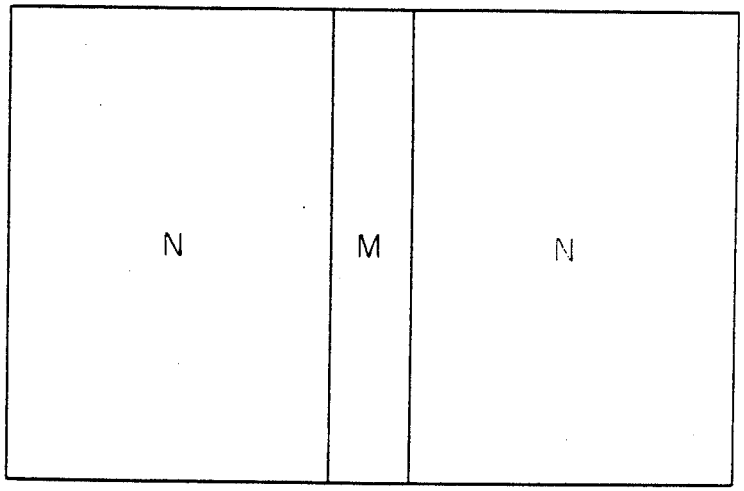
FIG. 3 is a diagram schematically illustrating a pattern of a plurality of regions of speed in an intensifying screen of the present invention for use in the X-ray radiography of the upper and lower jaws and the periphery thereof.

An intensifying screen (300 mm×200 mm) for X-ray radiography of the upper and lower jaws and the peripheries thereof was prepared by the following procedure, using calcium tungstate as a phosphor and fixing the speed distribution so that the speed in the region N would fall at 65 where that of the region M was taken as 100 in FIG. 3.

Preparation of light-absorbing layer

Figure 4:
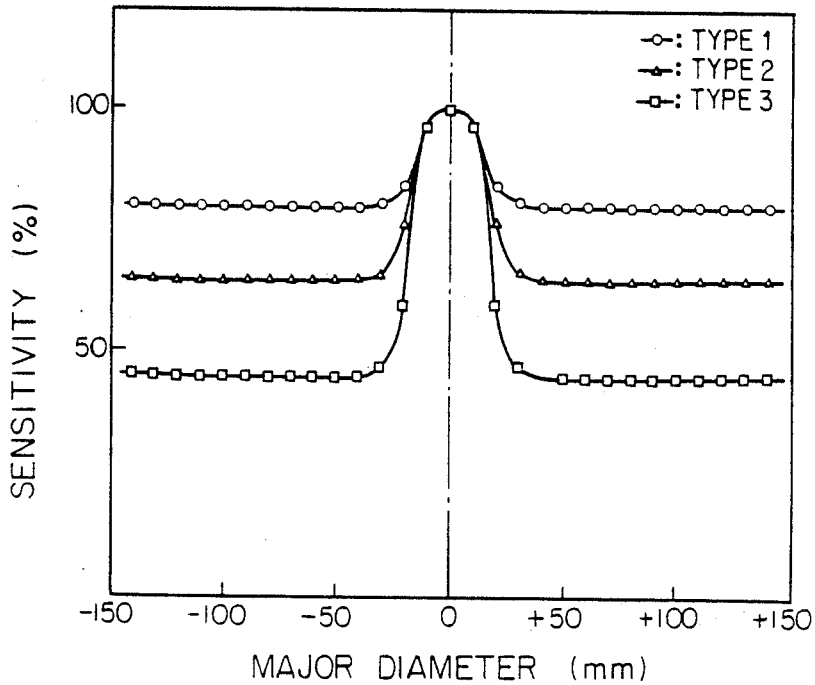
FIG. 4 is a graph showing the condition of speed distribution in an intensifying screen of the present invention for use in the X-ray radiography of the upper and lower jaws and the periphery thereof.

A black light-shielding plate provided in the central part thereof with an opening of the shape to give a shadow as illustrated in FIG. 3 was prepared. An X-ray film was disposed at a distance of about 10 mm downward from the light-shielding plate and exposed to light in the same manner as in Example 1. A printing plate was produced by using this X-ray film as a photogravure plate. Then, a light-absorbing layer was formed on a film of polyester 10 μm in thickness by depositing carbon black by following the procedure of Example 1. In this light-absorbing layer, the portions for starting speed change toward the portion corresponding to the strip of region M of high speed were located each at a distance of about 30 mm to the left and right from the center. The light-absorbing layer possessed a density change corresponding to Type 2 illustrated in FIG. 4.

Preparation of intensifying screen

Similarly to the intensifying screen of the construction shown in FIG. 5, the same calcium tungstate-containing slurry as used in Example 1 was applied on a protective layer 18 of polyester about 10 μm in thickness and the applied layer of the slurry was dried, to give rise to a second layer **14*b* of phosphor about 50 μm in thickness. The light absorbing layer 16 formed by the method described above was superposed on the second layer 14*b* of phosphor. Then, the phosphor slurry of the aforementioned composition was applied on the layer 16 and the applied layer of the slurry was dried, to give rise to a first layer 14*a* of phosphor 100 μm in thickness. Thereafter, a substrate 12 of polyester film incorporating therein titanium oxide or carbon black and having a thickness of 250 μm was attached fast on the first layer 14*a* of phosphor, to give rise to an intensifying screen 10** for X-ray radiography of the upper and lower jaws and the peripheries thereof.

Then, 50 persons were subjected to diagnostic examination by the X-ray radiography of the upper and lower jaws and the peripheries thereof, using the intensifying screen obtained as described above. In all the X-ray radiographs thus obtained, the parts were radiographed with substantially uniform density without suffering the shadow of the backbone to impair the distribution of radiographic density.

In accordance with present working example, since the light-absorbing layer was incorporated in the layer of phosphor in such a manner as to form a strip of region of high speed at the position practically corresponding to the backbone, the amount of light emitted in the portion corresponding to the backbone was increased enough to permit production of a highly desirable X-ray radiograph of the upper and lower jaws and the peripheries thereof without giving rise to a portion of uneven-density due to the difference in X-ray absorption between the backbone and the other parts. In the category of dentistry and surgery specializing in oral cavity, therefore, this invention enables diagnostic examination of the pertinent parts of the human body to be effected accurately with one X-ray radiography.

What is claimed:

1. A speed compensated intensifying screen for X-ray radiography of the head, comprising a substrate, a layer of phosphor formed on said substrate, a protective film formed on said layer of phosphor, and a light-absorbing layer serving to absorb the light emitted from said layer of phosphor proportionately to the part of the human body subjected to radiography, which intensifying screen is characterized by the fact that said light-absorbing layer enables said layer of phosphor to create a plurality of regions differing in speed, said plurality of regions of speed substantially comprise a substantially elliptical region J of high speed located substantially in the central part relative to the longitudinal cross section of the head, a region L of low speed corresponding to the outside of the contour of the head, and a region K corresponding to the head except for said region J of high speed and possessing a magnitude of speed of said region L and the speed across each of the borderlines of said regions of speed is continuously varied.

2. The intensifying screen according to claim 1, wherein the speed in said region K is substantially continuously lowered radially from said region J of high speed to said region L of low speed.

3. The intensifying screen according to claim 2, wherein the magnitudes of speed of said plurality of regions of speed are such that where the magnitude of the speed of said region J of high speed is taken as 100, the magnitude of said region L of low speed is not more than 50.

4. The intensifying screen according to any of claims 1 through 3, wherein the ratio of change in speed across each of said plurality of regions of speed and/or in said region K is continuous so that the produced X-ray radiograph shows no visibly discernible line pattern.

5. The intensifying screen according to any of claims 1 through 3, wherein said light-absorbing layer is formed on said layer of phosphor, or within said layer of phosphor.

6. The intensifying screen according to any of claims 1 through 3, wherein said light-absorbing layer comprises a filmlike material and a layer formed on said filmlike material with a substance capable of absorbing the light emitted from the phosphor used.

7. A speed compensated intensifying screen for X-ray radiography of the upper and lower jaws and the periphery thereof, comprising a substrate, a layer of phosphor formed on said substrate, a protective film formed on said layer of phosphor, and a light-absorbing layer serving to absorb the light emitted from said layer of phosphor proportionately to the part of the human body subjected to radiography, which intensifying screen is characterized by the fact that said light-absorbing layer enables said layer of phosphor to create a plurality of regions differing in speed, said plurality of regions of speed substantially comprise a beltlike region M of high speed extending from the central part of one end to the central part of the other end and substantially corresponding to the position of the cervical vertebra and another region N and the speed across each of the borderlines between said plurality of regions of speed is continuously varied.

8. The intensifying screen according to claim 7, wherein said belt-like region M of high speed exists along the center line extending from the center of one major side to the center of the other major side in a width in the range of 5 to 40 mm on either side of said central line.

9. The intensifying screen according to claim 8, wherein the magnitudes of speed in said plurality of regions of speed are such that when the magnitude of speed in said belt-like region M of high speed is taken as 100, the magnitude of speed in the other region N is in the range of 40 to 80.

10. The intensifying screen according to any of claims 7 through 9, wherein the ratio of change in speed across each of said plurality of borderlines of speed is continuous so that the produced X-ray radiograph shows no visibly discernible line pattern.

11. The intensifying screen according to any of claims 7 through 9, wherein said light-absorbing layeris formed on said layer of phosphor, or within said layer of phosphor.

12. The intensifying screen according to any of claims 7 through 9, wherein said light-absorbing layer comprises a filmlike material and a layer formed on said filmlike material with a substrate capable of absorbing the light emitted from the phosphor used.

* * * * *